US010930203B2

(12) United States Patent
Yue et al.

(10) Patent No.: US 10,930,203 B2
(45) Date of Patent: Feb. 23, 2021

(54) GRAYSCALE ADJUSTMENT CIRCUIT, METHOD FOR DRIVING THE SAME AND DISPLAY DEVICE

(71) Applicant: BOE TECHNOLOGY GROUP CO., LTD., Beijing (CN)

(72) Inventors: Han Yue, Beijing (CN); Minghua Xuan, Beijing (CN); Ning Cong, Beijing (CN); Ming Yang, Beijing (CN); Can Zhang, Beijing (CN); Can Wang, Beijing (CN); Xiaochuan Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/450,288

(22) Filed: Jun. 24, 2019

(65) Prior Publication Data

US 2020/0020274 A1 Jan. 16, 2020

(30) Foreign Application Priority Data

Jul. 13, 2018 (CN) ..... 201810772456.8

(51) Int. Cl.
*G09G 3/32* (2016.01)

(52) U.S. Cl.
CPC ..... *G09G 3/32* (2013.01); *G09G 2300/08* (2013.01); *G09G 2320/0626* (2013.01)

(58) Field of Classification Search
CPC ..... G09G 3/32; G09G 2300/08; G09G 2320/0626; G09G 2310/08; G09G 3/2007
See application file for complete search history.

(56) References Cited

U.S. PATENT DOCUMENTS 9,959,801 B2 * 5/2018 Ohara ..... G09G 3/3258
10,170,045 B2 * 1/2019 Yamanaka ..... G09G 3/3258
(Continued)

FOREIGN PATENT DOCUMENTS

CN 1617206 A 5/2005
CN 1670800 A 9/2005
(Continued)

OTHER PUBLICATIONS

First Office Action for Chinese Application No. 201810772456.8, dated Nov. 5, 2019, 7 Pages.
(Continued)

*Primary Examiner* — Jose R Soto Lopez
(74) *Attorney, Agent, or Firm* — Brooks Kushman P.C.

(57) ABSTRACT

A grayscale adjustment circuit, a driving method thereof and a display device are provided. The circuit includes: an input sub-circuit configured to output a signal of a data signal terminal to a driving sub-circuit under a control of the scanning signal terminal, the driving sub-circuit configured to store an output signal of the input sub-circuit and output a signal of the first voltage terminal to a switching control sub-circuit under a control of the output signal of the input sub-circuit, a switching time control sub-circuit configured to output a signal of each switching time signal terminal to the switching control sub-circuit under a control of each switching time control terminal, the switching control sub-circuit configured to output an output signal of the driving sub-circuit to the light-emitting sub-circuit under a control of an output signal of the switching time control sub-circuit to control the light-emitting sub-circuit to emit light.

14 Claims, 4 Drawing Sheets

(56) References Cited

U.S. PATENT DOCUMENTS

| | | | | |
|---|---|---|---|---|
| 10,339,866 | B2 * | 7/2019 | Noguchi | G09G 3/3233 |
| 2005/0104875 | A1 * | 5/2005 | Kwak | G09G 3/3233 345/204 |
| 2005/0200573 | A1 * | 9/2005 | Kwak | G09G 3/3233 345/76 |
| 2006/0061525 | A1 * | 3/2006 | Kim | H01L 27/3276 345/76 |
| 2016/0210892 | A1 * | 7/2016 | Ohara | G09G 3/3266 |
| 2017/0039934 | A1 * | 2/2017 | Ma | G09G 3/32 |
| 2017/0162167 | A1 * | 6/2017 | Zhang | G09G 3/3677 |
| 2017/0269416 | A1 * | 9/2017 | Miao | G09G 3/3688 |
| 2018/0053460 | A1 * | 2/2018 | Watsuda | G09G 3/2074 |
| 2018/0151125 | A1 * | 5/2018 | Lee | G09G 3/3233 |
| 2018/0240405 | A1 * | 8/2018 | Li | G09G 3/3406 |
| 2019/0164492 | A1 * | 5/2019 | Oh | G09G 3/3258 |
| 2019/0164494 | A1 * | 5/2019 | Bae | G09G 3/3233 |
| 2019/0362667 | A1 * | 11/2019 | Ma | G09G 3/3233 |

FOREIGN PATENT DOCUMENTS

| | | | |
|---|---|---|---|
| CN | 104732926 | A | 6/2015 |
| CN | 104934012 | A | 9/2015 |
| CN | 105206242 | A | 12/2015 |
| CN | 107342047 | A | 11/2017 |
| CN | 107767811 | A | 3/2018 |
| KR | 20060026787 | A | 3/2006 |

OTHER PUBLICATIONS

Second Office Action for Chinese Application No. 201810772456.8, dated Jun. 18, 2020, 8 Pages.

* cited by examiner

GRAYSCALE ADJUSTMENT CIRCUIT, METHOD FOR DRIVING THE SAME AND DISPLAY DEVICE

CROSS-REFERENCE TO RELATED APPLICATION

This application claims priority to Chinese Patent Application No. 201810772456.8 filed on Jul. 13, 2018, which is incorporated herein by reference in its entirety.

TECHNICAL FIELD

The present disclosure relates to the field of display technology, and in particular to a grayscale adjustment circuit, a method for driving the same and a display device.

BACKGROUND

At present, Micro Light Emitting Diode (Micro LED) components are widely used in the display field due to the advantages of high brightness and high stability. In the case that a current density is low, the Micro LED has a low luminous efficiency.

SUMMARY

In a first aspect, a grayscale adjustment circuit is provided according to an embodiment of the present embodiments, including an input sub-circuit, a driving sub-circuit, a switching time control sub-circuit, a switching control sub-circuit and a light-emitting sub-circuit;

the input sub-circuit is coupled to a scanning signal terminal, a data signal terminal and the driving sub-circuit, and the input sub-circuit is configured to output a signal of the data signal terminal to the driving sub-circuit under a control of the scanning signal terminal;

the driving sub-circuit is coupled to a first voltage terminal, a second voltage terminal and the switching control sub-circuit, and the driving sub-circuit is configured to store an output signal of the input sub-circuit and output a signal of the first voltage terminal to the switching control sub-circuit under a control of the output signal of the input sub-circuit;

the switching time control sub-circuit is coupled to at least one switching time control terminal, at least one switching time signal terminal and the switching control sub-circuit, and the switching time control sub-circuit is configured to output a signal of each of the at least one switching time signal terminal to the switching control sub-circuit under a control of each of the at least one switching time control terminal;

the switching control sub-circuit is coupled to the light-emitting sub-circuit, and the switching control sub-circuit is configured to output an output signal of the driving sub-circuit to the light-emitting sub-circuit under a control of an output signal of the switching time control sub-circuit; and the light-emitting sub-circuit is coupled to the second voltage terminal, and the light-emitting sub-circuit is configured to emit light under a control of the output signal of the driving sub-circuit.

In some optional embodiments, the input sub-circuit includes a first transistor, a gate electrode of the first transistor is coupled to the scanning signal terminal, a first electrode of the first transistor is coupled to the data signal terminal, and a second electrode of the first transistor is coupled to the driving sub-circuit.

In some optional embodiments, the driving sub-circuit includes a first capacitor and at least one second transistor, a gate electrode of each of the at least one second transistor is coupled to the second electrode of the first transistor, and a first electrode of each second transistor is coupled to the first voltage terminal, and a second electrode of each second transistor is coupled to the switching control sub-circuit. A first end of the first capacitor is coupled to the second electrode of the first transistor, and a second end of the first capacitor is coupled to the second voltage terminal.

In some optional embodiments, the switching time control sub-circuit includes a plurality of third transistors, a gate electrode of each of the plurality of third transistors is coupled to one of the at least one switching time control terminal, a first electrode of each of the plurality of third transistors is coupled to one of the at least one switching time signal terminal, and a second electrode of each of the plurality of third transistors is coupled to the switching control the sub-circuit.

In some optional embodiments, the number of the plurality of third transistors is same as the number of the at least one switching time signal terminal, the plurality of third transistors corresponds to the at least one switching time signal terminal respectively, and the first electrode of each of the plurality of third transistors is coupled to the corresponding switching time signal terminal.

In some optional embodiments, the switching control sub-circuit includes a plurality of fourth transistors, a gate electrode of each of the plurality of fourth transistors is coupled to a second electrode of one of the third transistors, a first electrode of each of the plurality of fourth transistors is coupled to a second electrode of one of the at least one the second transistor, and a second electrode of each of the plurality of four transistors is coupled to the light-emitting sub-circuit.

In some optional embodiments, the number of the plurality of fourth transistors is same as the number of the plurality of third transistors, the plurality of fourth transistors corresponds to the plurality of third transistors respectively, and a gate electrode of each of the plurality of fourth transistors is coupled to the second electrode of the corresponding third transistor.

In some optional embodiments, the number of the at least one second transistor is same as the number of the plurality of fourth transistors, the at least one second transistor corresponds to the plurality of fourth transistors respectively, and the first electrode of each of the plurality of fourth transistors is coupled to the second electrode of the corresponding second transistor; or the number of the at least one second transistor is one, and the first electrode of each of the plurality of fourth transistors is coupled to the second electrode of the second transistor.

In some optional embodiments, the light-emitting sub-circuit includes a plurality of light-emitting diodes, and the plurality of light-emitting diodes corresponds to the plurality of fourth transistors respectively. A first electrode of each of the plurality of light-emitting diodes is coupled to a second electrode of the corresponding fourth transistor, and a second electrode of each of the plurality of light-emitting diodes is coupled to the second voltage terminal.

In some optional embodiments, in the case that a voltage of the first voltage terminal is higher than a voltage of the second voltage terminal, the first electrodes of the plurality of light-emitting diodes are anodes, and the second electrodes of the plurality of light-emitting diodes are cathodes; or in the case that a voltage of the first voltage terminal is lower than a voltage of the second voltage terminal, the first electrodes of the plurality of light-emitting diodes are cathodes, and the second electrodes of the plurality of light-emitting diodes are anodes.

In some optional embodiments, all the transistors in the grayscale adjustment circuit are N-type transistors or P-type transistors.

In a second aspect, a display device is provided according to an embodiment of the present embodiments, including the grayscale adjustment circuit as described above.

In a third aspect, a method for driving the grayscale adjustment circuit is provided according to an embodiment of the present embodiments, in which each work cycle of the grayscale adjustment circuit includes a writing phase and an adjustment phase, the method includes: inputting an enable signal to the scanning signal terminal and the data voltage terminal and inputting a non-enable signal to the at least one switching time control terminal during the writing phase; and inputting the enable signal to the at least one switching time control terminal and inputting a pulse signal to the at least one switching time signal terminal during the adjustment phase.

In some optional embodiments, the number of the at least one switching time signal terminal is n and the light-emitting sub-circuit includes n light-emitting diodes (LEDs), the method further includes: inputting, during the adjustment phase, the pulse signal to x switching time signal terminals and inputting the non-enable signal to remaining (n−x) switching time signal terminals to control the number of the LEDs in a light-emitting state to be x, in which the x and the n both are positive integers and x is less than or equal to n.

BRIEF DESCRIPTION OF THE DRAWINGS

In order to more clearly illustrate the technical solutions of the embodiments of the present disclosure, the drawings to be used in the description of the embodiments of the present disclosure will be described briefly below. Obviously, the drawings in the following description are merely some embodiments of the present disclosure. For those skilled in the art, other drawings can also be obtained according to these drawings without the inventive labor.

DETAILED DESCRIPTION

Technical solutions of the embodiments of the present disclosure will be clearly and completely described below in conjunction with the drawings of the embodiments of the present disclosure. It is apparent that the described embodiments are a part of the embodiments of the present disclosure, rather than all of them. Based on the described embodiments of the present disclosure, other embodiments obtained by those skilled in the art without creative effort shall fall within the protective scope of the disclosure.

Figure 1:
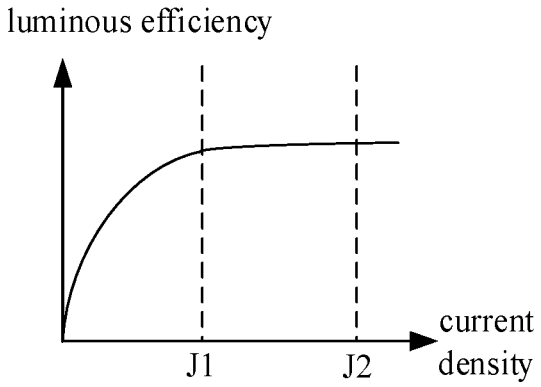
FIG. 1 shows a schematic diagram of a luminous efficiency of a Micro LED varying with a current density according to an embodiment of the present disclosure.

A Micro LED is a self-luminous component. FIG. 1 shows a schematic diagram of a luminous efficiency of the Micro LED varying with a current density according to an embodiment of the present disclosure. As shown in FIG. 1, in the case that the current density is in a range of between J1 and J2, a luminous efficiency of the Micro LED is substantially stabilized; in the case that the current density is lower than a threshold J1, the luminous efficiency of the Micro LED decreases as the current density decreases. In the case that the current density is used to modulate a grayscale, a low grayscale corresponds to a low current density, and accordingly, the luminous efficiency is decreased.

In a display field, a relationship between display brightness and grayscale is based on a relationship of Gamma 2.2: $L_n=(n/N)^{2.2}\times(L_N-L_0)+L_0$, called Formula 1, in which N is a maximum grayscale number, n is a grayscale number, $L_n$ is a brightness corresponding to the grayscale n, $L_N$ is a brightness corresponding to the maximum grayscale number N, and it is assumed $L_0=0$ for simplifying a calculation.

Display brightness=the number of light-emitting chips× current (voltage)×luminous efficiency×light-emitting time. The currents of the light-emitting chip have a one-to-one correspondence with the voltages between two ends of the chip. A modulation voltage corresponds to a modulation current. When the low grayscale is modulated by the low current density, the luminous efficiency of the Micro LED is low.

In addition, according to the Formula 1, in the case that the grayscale is low and n is 1, the maximum grayscale is $N=(L_N/L_1)^{1/2.2}$. It can be seen that the maximum grayscale number N depends on a ratio of the brightness corresponding to a grayscale N to the brightness corresponding to a grayscale 1, and the number of the grayscales is determined based on the maximum grayscale number N. If the brightness is modulated only by controlling the light-emitting time, the number of adjustable grayscales is limited. For example, a resolution of a display is 360×360, a refresh rate is 60 Hz, the light-emitting time of each line is $1\div60\div360\times10^3$ s$=4.6\times10^4$ ns, a response time of the transistor is 500 ns and $L_N/L_1=46000$ ns/500 ns=92, so the maximum number N of adjustable grayscales is 8.

In summary, the method in which the Micro LED in related art modulates the low grayscale has a problem that the luminous efficiency is low or the number of adjustable grayscales is limited.

Figure 2:
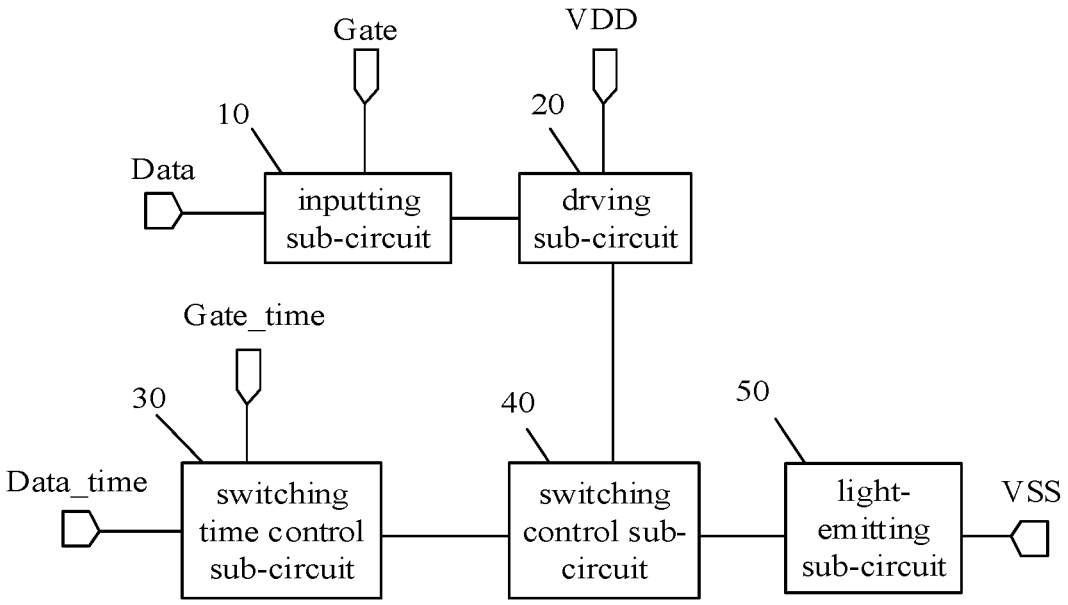
FIG. 2 shows a schematic diagram of a grayscale adjustment circuit according to an embodiment of the present disclosure.

For these reasons above, a grayscale adjustment circuit is provided according to an embodiment of the present embodiments. As shown in FIG. 2, the grayscale adjustment circuit includes an input sub-circuit 10, a driving sub-circuit 20, a switching time control sub-circuit 30, a switching control sub-circuit 40 and a light-emitting sub-circuit 50.

The input sub-circuit 10 is coupled to a scanning signal terminal Gate, a data signal terminal Data and the driving sub-circuit 20. The input sub-circuit 10 is configured to output a signal of the data signal terminal Data to the driving sub-circuit 20 under a control of the scanning signal terminal Gate.

The driving sub-circuit 20 is coupled to a first voltage terminal VDD, a second voltage terminal VSS and the switching control sub-circuit 40. The driving sub-circuit 20 is configured to output a signal of the first voltage terminal VDD to the switching control sub-circuit 40 under a control of the output signal of the input sub-circuit 10.

The switching time control sub-circuit 30 is coupled to a switching time control terminal Gate time, at least one switching time signal terminal Data time and the switching control sub-circuit 40. The switching time control sub-circuit 30 is configured to output a signal of the switching time signal terminal Data time to the switching control sub-circuit 40 under a control of each switching time control terminal Gate time.

The switching control sub-circuit 40 is coupled to the light-emitting sub-circuit 50. The switching control sub-circuit 40 is configured to output an output signal of the driving sub-circuit 20 to the light-emitting sub-circuit 50 under a control of an output signal of the switching time control sub-circuit 40 to control the light-emitting sub-circuit 50 to emit light. The light-emitting sub-circuit 50 is coupled to the second voltage terminal VSS.

Thus, the grayscale adjustment circuit provided by some embodiments of the present disclosure is used to modulate grayscale. Specifically, during a writing phase, the input sub-circuit 10 outputs the signal of the data signal terminal Data to the driving sub-circuit 20 under the control of the scanning signal terminal Gate; the driving sub-circuit 20 outputs the signal of the first voltage terminal VDD to the switching control sub-circuit 40 under the control of the output signal of the input sub-circuit 10. During a light-emitting phase, the switching time control sub-circuit 30 outputs the signal of the switching time signal terminal Data time to the switching control sub-circuit 40 under the control of the switching time control terminal Gate time; the switching control sub-circuit 40 outputs the output signal of the drive sub-circuit 20 to the light-emitting sub-circuit 50 under the control of the output signal of the switching control sub-circuit 40 to control the light-emitting sub-circuit 50 to emit light. Based on the above, during the writing phase, a degree to which the signal of the first voltage terminal VDD is written to the switching time control sub-circuit 30 can be controlled by controlling a magnitude of the voltage of the data signal terminal Data, thereby controlling a magnitude of the signal of the first voltage terminal VDD outputted to the light-emitting sub-circuit 50, so as to control the voltage/current between two ends of the light-emitting chip in the light-emitting sub-circuit 50 and the light-emitting brightness of the light-emitting chip. During the light-emitting phase, whether and how long each light-emitting chip in the light-emitting sub-circuit 50 turns on can be controlled by controlling the signal of the switching time signal terminal Data time.

Based on the above, the grayscale adjustment circuit provided by some embodiments of the present disclosure can set the number of the light-emitting chips, the voltage/current between two ends of the light-emitting chip and the light-emitting time as adjustable parameters, so that the ratio of the brightness between the maximum grayscale and a minimum grayscale can be increased, thereby increasing the number of the adjustable grayscales. Therefore, when the adjustable parameters are set, the current density can be stabilized by stabilizing the voltage between the two ends of the light-emitting chip, so that the grayscale adjustment circuit can operate with a highest efficiency. In this case, the grayscale can be modulated by adjusting the number of the light-emitting chips and the light-emitting time.

Optionally, in the case that the grayscale adjustment circuit according to some embodiments of the present disclosure modulates a high grayscale, the voltage/current between the two ends of the light-emitting chip can be adjusted; when a medium grayscale is modulated, it can be controlled by adjusting the number of light-emitting chips; and when the low grayscale is modulated, it can be achieved by controlling the light-emitting time of the light-emitting chip, thereby solving the problem that the efficiency of the light-emitting chip is low when the low grayscale is adjusted by the current.

A structure of the grayscale adjustment circuit described above will be exemplified and illustrated in conjunction with the specific embodiments.

Figure 3:
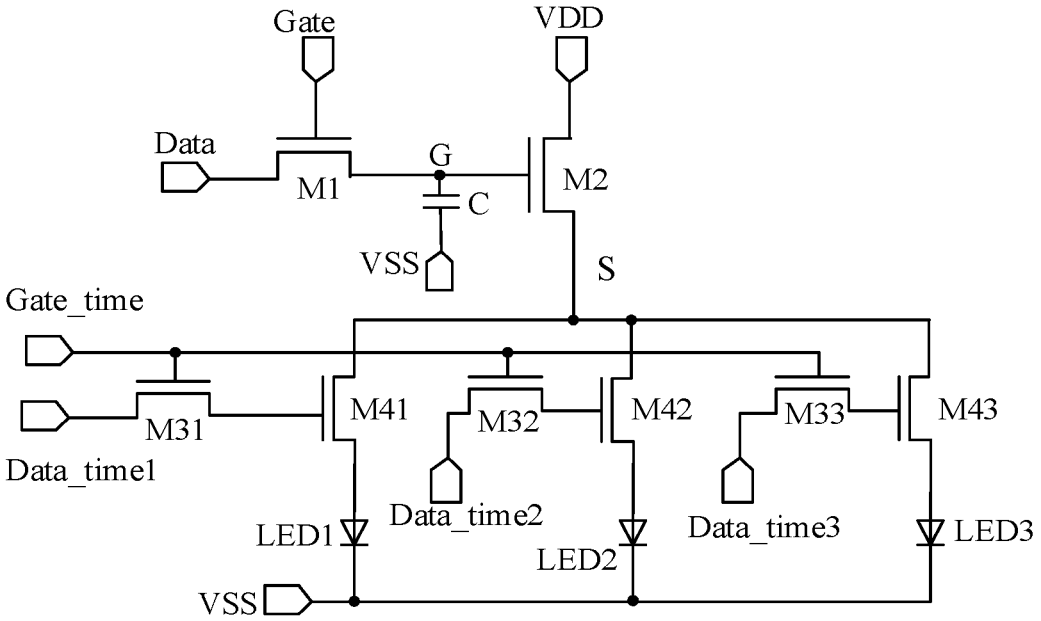
FIG. 3 shows a schematic diagram of a grayscale adjustment circuit according to an embodiment of the present disclosure.

FIG. 3 shows a schematic diagram of a grayscale adjustment circuit according to an embodiment of the present disclosure. As shown in FIG. 3, the input sub-circuit 10 includes a first transistor M1; a gate electrode of the first transistor M1 is coupled to the scanning signal terminal Gate, a first electrode of the first transistor M1 is coupled to the data signal terminal Gate, and a second electrode of the first transistor M1 is coupled to the driving sub-circuit 20.

The driving sub-circuit 20 includes a second transistor M2 and a first capacitor C; a gate electrode of the second transistor M2 is coupled to the second electrode of the first transistor M1, and a first electrode of the second transistor M2 is coupled to the first voltage terminal VDD, and a second electrode of the second transistor M2 is coupled to the switching control sub-circuit 40; the second transistor M2 is a N-type transistor; one end of the first capacitor C is coupled to the second electrode of the first transistor M1, and the other end of the first capacitor C is coupled to the second voltage terminal VSS.

The switching time control sub-circuit 30 includes a plurality of third transistors, the switching control sub-circuit 40 includes a plurality of fourth transistors, and the light-emitting sub-circuit 50 includes a plurality of light-emitting diodes.

Optionally, an example that the switching time control sub-circuit 30 including three third transistors, the switching control sub-circuit 40 including three fourth transistors and the light-emitting sub-circuit 50 including three light-emitting diodes is taken as an example for description in the present embodiment. In order to describe conveniently, the three third transistors are denoted by reference numerals M31, M32 and M33 respectively, and the three fourth transistors are denoted by reference numerals M41, M42 and M43 respectively, and the three light-emitting diodes are denoted by LED1, LED2 and LED3 respectively. It should be noted that the number of LEDs is not limited to three, and can be set according to an actual requirement.

The numbers of the third transistors, the fourth transistors, the LEDs and the switching time control terminals may be the same.

Gate electrodes of the M31, M32 and M33 are coupled to the switching time control terminal Gate time. A first electrode of the M31 is coupled to a switching time control terminal Data time1, and a second electrode of the M31 is coupled to a gate electrode of M41. A first electrode of M32 is coupled to a switching control terminal Data time2, and a second electrode is coupled to a gate electrode of M42. A first electrode of M33 is coupled to a switching time control terminal Data time3, and a second electrode is coupled to a gate electrode of M43.

First electrodes of M41, M42, and M43 are coupled to the second electrode of M2, and second electrodes of M41, M42, and M43 are respectively coupled to anodes of the LED1, LED2, and LED3, and cathode of each light-emitting diode is coupled to the second voltage terminal VSS.

In some optional embodiments, the first voltage terminal and the second voltage terminal may be interchanged, that is, the first voltage terminal is a low voltage terminal VSS, and the second voltage terminal is a high voltage terminal VDD; it is only necessary to connect the anodes of the light-emitting diodes LED1, LED2 and LED3 to the high voltage terminal VDD and connect the cathodes of the light-emitting diodes to the low voltage terminal VSS.

Optionally, each of the transistors in the grayscale adjustment circuit of the present embodiment is an N-type transistor. When the grayscale adjustment circuit is manufactured, a process flow for manufacturing the grayscale adjustment circuit is unified. The grayscale adjustment circuit described above can be manufactured only by the process for manufacturing the N-type transistor. Therefore, the grayscale adjustment circuit can be manufactured by a backplate process including an oxide, a silicon base and a low temperature poly-silicon (LTPS). It should be noted that when the transistor is the N-type transistor, the first electrode is a drain and the second electrode is a source.

FIG. 3 shows three switching time signal terminals Data time1, Data time2 and Data time3. In some other optional embodiments, the number of the switching time signal terminal may be one, and the M31, M32 and M33 may be simultaneously coupled to the same switching time signal terminal, thereby avoiding delay among the signals from a plurality of different switching time signal terminals and ensuring the light-emitting states of the LED1, LED2, and LED3 to be basically the same.

Figure 4:
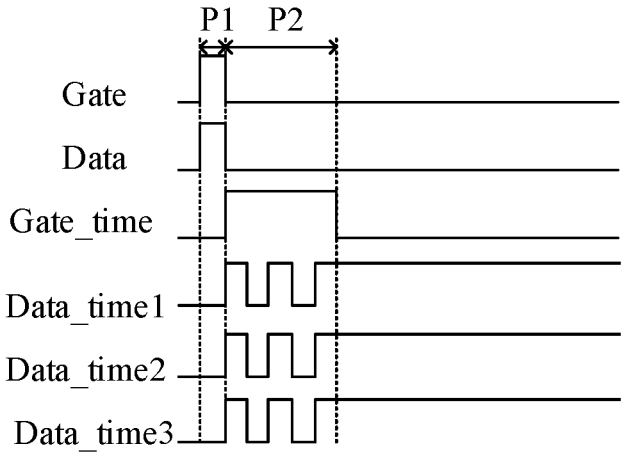
FIG. 4 shows a timing control diagram of the grayscale adjustment circuit as shown in FIG. 3.

FIG. 4 shows a timing control diagram of the grayscale adjustment circuit according to FIG. 3. A working process of the grayscale adjustment circuit as described above will be illustrated below with reference to FIGS. 3 and 4. Each work cycle of the grayscale adjustment circuit includes a writing phase P1 and an adjustment phase P2.

During the writing phase P1, both the scanning signal terminal Gate and the data voltage terminal Data are inputted with a high level signal. Under a control of the high level signal of the scanning signal terminal Gate, the first transistor M1 is turned on, and the high level signal of the data voltage terminal Data is outputted to the gate electrode G of the second transistor M2 and stored to the first capacitor C. Since the gate electrode G is at the high level, the second transistor M2 is turned on. A low level signal is inputted into switching time control terminal Gate time, the M31, M32 and M33 are turned off, and M41, M42 and M43 are also turned off. The LED1, LED2, and LED3 do not emit light.

During the adjustment phase P2, the switching time control terminal Gate time is inputted with the high level signal. Under the control of the high level signal of the switching time control terminal Gate time, the M31, M32 and M33 are turned on, and the signals of the switching time signal terminals Data time1, Data time2 and Data time3 are respectively outputted to the gates of the M41, M42 and M43 for controlling the M41 and M42 and M43 to be turned on or off. Thus, under the control of the signals of the switching time signal terminals Data time1, Data time2 and Data time3, the signals of the first voltage terminal VDD are controlled to be or not to be outputted to the anodes of the LED1, LED2, and LED3 respectively, thereby controlling the light-emitting diodes LED1, LED2, and LED3 to be turned on or off. In addition, a length of time when the light-emitting diodes LED1, LED2, or LED3 are turned on is controlled by a total time duration during which the high level signal is inputted into the switching time signal terminal Data time1, Data time2 or Data time3. For example, when the switching time signal terminal Data time1 is at a high level, the fourth transistor M41 is turned on, the LED1 emits light, and the time duration of the high level inputted to the switching time signal terminal Data time1 determines a length of the light-emitting time of the light-emitting diode LED1.

In the present embodiment, the second transistor M2 corresponds to a source follower in which a source electrode S of the source electrode follower will be changed in accordance with a change of the voltage of the gate electrode G. The source electrode S corresponds to the voltage of the gate electrode G respectively. The voltage of the source electrode S will be increased with the voltage of the gate electrode G increasing. The voltage of the source electrode S is outputted to the anodes of the light-emitting diodes LED1, LED2 and LED3 through M41, M42, and M43. Based on the above, the voltage of the source electrode S determines the voltage between the two ends of the LED and further determines the light-emitting brightness of the LED. In other words, the gate electrode G corresponds to the voltage between the two ends of the LED and the light-emitting brightness of the LED respectively, so that the voltage between the two ends of the LED and the light-emitting brightness of the LED can be controlled by controlling the voltage of the gate electrode G.

Based on the above, as shown in FIG. 1, in the present embodiment, the voltage between the two ends of the LED may be set to V1-V2 and the current density of the LED ranges from J1 to J2, so that the grayscale adjustment circuit can operate with the highest efficiency. It should be understood that, the current density ranging from J1 to J2 when the LED operates stably is determined by the type of the LED. The current density ranging from J1 to J2 can be obtained according to a test which is not described herein.

Figure 5:
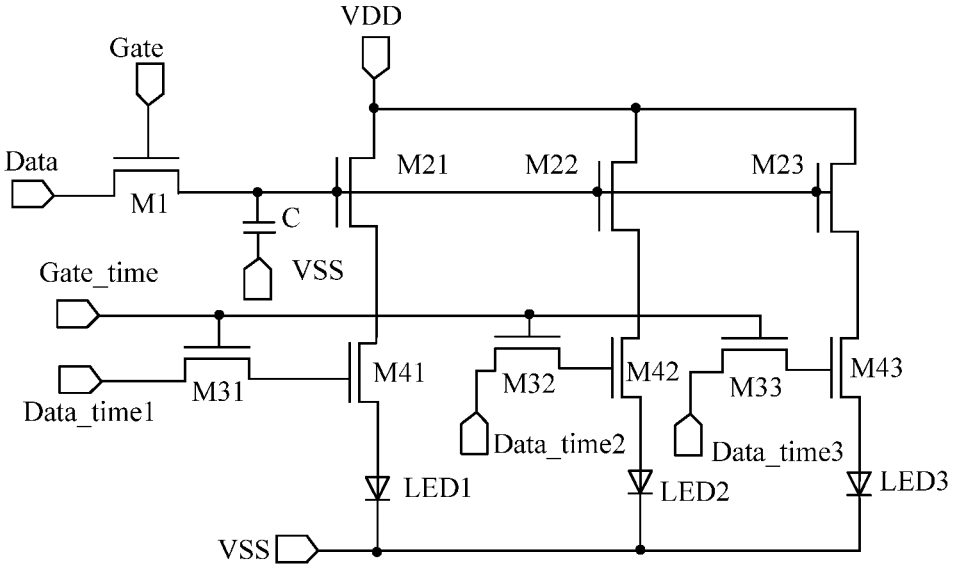
FIG. 5 shows a schematic diagram of a grayscale adjustment circuit according to an embodiment of the present disclosure.

FIG. 5 shows a schematic diagram of a grayscale adjustment circuit according to an embodiment of the present disclosure. In the grayscale adjustment circuit according to the embodiments, configurations of the input sub-circuit 10, the switching time control sub-circuit 30, the switching control sub-circuit 40 and the light-emitting sub-circuit 50 are the same as those of the above embodiments, and thus will not be described in detail in the present embodiment. The difference is that, in the present embodiment, the driving sub-circuit 20 includes at least two second transistors and the first capacitor C.

Optionally, in order to reduce the difference among the driving currents of the light-emitting diodes, the number of the second transistors is the same as the number of the light-emitting diodes. As shown in FIG. 5, the switching control sub-circuit 40 includes M41, M42 and M43, and the driving sub-circuit 20 includes three second transistors denoted by reference numerals M21, M22 and M23 respectively.

Gate electrodes of the M21, M22 and M23 are coupled to the second electrode of the first transistor M1. The second electrodes of the M21, M22 and M23 are coupled to the first voltage terminal VDD. The first electrode of the M21 is coupled to the first electrode of the M41. The first electrode of the M22 is coupled to the first electrode of the M42. The first electrode of the M23 is coupled to the first electrode of the M43. The three second transistors are all P-type transistors. One end of the first capacitor C is coupled to the second electrode of the first transistor the M1, and the other end is coupled to the second voltage terminal VSS. Optionally, the transistors in the grayscale adjustment circuit of the present embodiment are all P-type transistors. Thus, when the grayscale adjustment circuit is manufactured, the process flow for manufacturing the grayscale adjustment circuit is unified. The grayscale adjustment circuit described above can be manufactured only by the process for manufacturing the P-type transistor. It should be noted that in the case that the transistor is a P-type transistor, the first electrode is the source and the second electrode is the drain.

Figure 6:
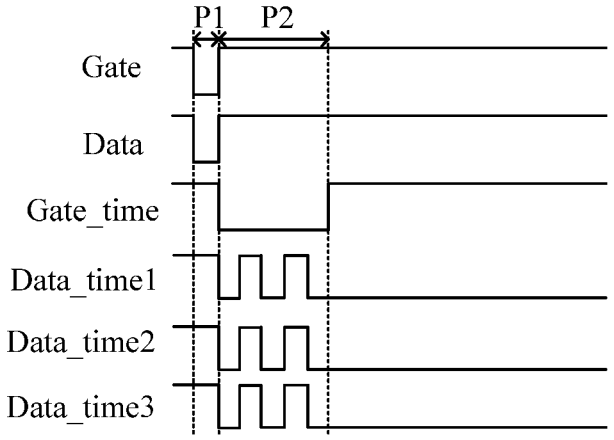
FIG. 6 shows a timing control diagram of the grayscale adjustment circuit as shown in FIG. 5.

FIG. 6 shows a timing control diagram of the grayscale adjustment circuit according to the present embodiment. The working process of the grayscale adjustment circuit as described above will be illustrated below with reference to FIG. 6. Each work cycle of the grayscale adjustment circuit includes a writing phase P1 and an adjustment phase P2.

During the writing phase P1, both the scanning signal terminal Gate and the data voltage terminal Data are inputted with a low level signal. Under a control of the low level signal of the scanning signal terminal Gate, the first transistor M1 is turned on, and the low level signal of the data voltage terminal Data is outputted to the gates of the M21, M22 and M23 and the M21, M22 and M23 are turned on. The low level signal of the data voltage terminal Data is stored in the first capacitor C. The switching time control terminal Gate time is inputted with a high level signal, the M31, M32 and M33 are turned off, and M41, M42 and M43 are also turned off. The LED1, LED2, and LED3 do not emit light.

During the adjustment phase P2, the switching time control terminal Gate time is inputted with the low level signal. Under the control of the low level signal of the switching time control terminal Gate time, the M31, M32 and M33 are turned on. The signal of the switching time signal terminal Data time1 is outputted to the gate electrode of the M41, the signal of the switching time signal terminal Data time2 is outputted to the gate electrode of the M42 and the signal of the switching time signal terminal Data time3 is outputted to the gate electrode of the M43 for respectively controlling the M41 and M42 and M43 to be turned on or off. Thus, under the control of the signals of the switching time signal terminals Data time1, Data time2 and Data time3, the signals of the first voltage terminal VDD are controlled to be or not to be outputted to the anodes of the LED1, LED2, and LED3 respectively, thereby controlling the light-emitting diodes LED1, LED2, and LED3 to be turned on or off. In addition, a length of time when the light-emitting diodes LED1, LED2, or LED3 are turned on is controlled by a total time duration during which the high level signal is inputted into the switching time signal terminal Data time1, Data time2 or Data time3. When the switching time signal terminal Data time is floating or inputted with a non-enable signal, the LED corresponding to the Data time does not emit light. Therefore, the number of LED chips which emit light and the length of time when the LED is turned on can be controlled by the signal of the switching time signal terminal.

As shown in FIG. 6, in some optional embodiments, during the adjustment phase P2, a pulse signal is inputted into the switching time signal terminal Data time for controlling the LED corresponding to the Data time to alternately emit light.

In the present embodiment, each of the M21, M22, M23 constitutes a current source component. The current through each transistor is $I=K\times(Vgs-Vth)^2$, in which k is a constant, Vgs is a gate-source voltage and Vth is a threshold voltage. The gate electrodes of the M21, M22 and M23 receive the data signal Data, and the source electrode receives a power signal VDD. Thus $I=K\times(Vdata-VDD-Vth)^2$, and the voltage of the data signal Data determines the magnitude of the current of each transistor. In the present embodiment, the current through the LED1, LED2 and LED3 is approximately equal to the current through the M21, M22, and M23 respectively.

Based on the above, as shown in FIG. 1, in the present embodiment, the current density of the corresponding light-emitting diode can be set in the range of J1-J2 by setting the voltage of the data signal Data, thereby making the grayscale adjustment circuit operate with the highest efficiency.

Based on the above, when the current density of the light-emitting diode is in the range of J1-J2, the grayscale adjustment circuit can modulate the grayscale by controlling the voltage between two ends of the light-emitting diode, the number of the light-emitting diodes which is turned on and the length of time when the light-emitting diodes turn on, in which display brightness=the number of light-emitting chips×current (voltage)×luminous efficiency×light-emitting time. Therefore, the grayscale adjustment circuit according to the embodiment of the present disclosure can modulate the grayscale by adjusting the voltage between the two ends of the light-emitting diode, the number of the light-emitting diodes which is turned on and the length of time when the light-emitting diodes turn on, so that the grayscale adjustment circuit can operate with the highest efficiency and more number of the grayscales can be adjusted.

For example, a resolution of a display is 360×360, a refresh rate is 60 Hz, the light-emitting time of each line is $1\div60\div360\times10^3$ s=$4.6\times10^4$ ns, a response time of the transistor is 500 ns, the maximum current density/the minimum current density=J2/J1=700, the ratio of the maximum number of the light-emitting diodes to the minimum number of the light-emitting diodes is 3 and $L_N/L_1$=46000 ns×700×3/500 ns=193200, so the maximum number N of adjustable grayscales is 255.

TABLE 1

| maximum grayscale number | current density | number of LEDs | ratio of light-emitting time to non-light-emitting time |
|---|---|---|---|
| 255 | J2 | 3 | 100% |
| 120 | J1 | 3 | 100% |
| 100 | J1 | 2 | 100% |
| 70 | J1 | 1 | 100% |

Table 1 shows four grayscales modulated by a combination of the number of modulated light-emitting diodes and the light-emitting time provided by the present embodiment. The number of light-emitting diodes is the number of light-emitting diodes which are turned on. When modulating the grayscale, the light-emitting diodes are not always turned on and can emit light according to the ratio of light-emitting time to the non-light-emitting time as described above.

Based on the above, the display brightness of the grayscale adjustment circuit can be determined by the number of light-emitting diodes in the grayscale adjustment circuit, the light-emitting time and the current/voltage between the two ends of the light-emitting. There are a plurality of implementation solutions that can be used to modulate the grayscale according to the above three parameters. For example, the brightness $L_{100}$ of the grayscale 100 can be realized by turning on two light-emitting diodes and a 100% light-emitting ratio of each light-emitting diode or can be realized by turning on three light-emitting diodes and a 67% light-emitting ratio of each light-emitting diode, but the present disclosure is not limited to this. In practical applications, reasonable parameters can be designed according to actual conditions.

Figure 7:
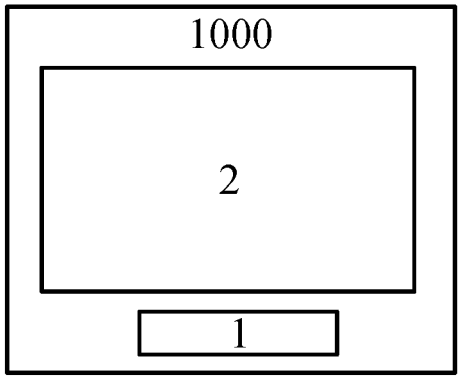
FIG. 7 shows a schematic diagram of a display device according to an embodiment of the present disclosure.

A display device is provided according to embodiments of the present disclosure. As shown in FIG. 7, the display device 1000 includes any one of the grayscale adjustment circuit 1 and the display 2 as described above, and has the same structure and advantageous effects as the grayscale adjustment circuit provided by the foregoing embodiments. Since the foregoing embodiment has been described in detail for the same structure and advantageous effects of the grayscale adjustment circuit, details are not described herein again.

Figure 8:
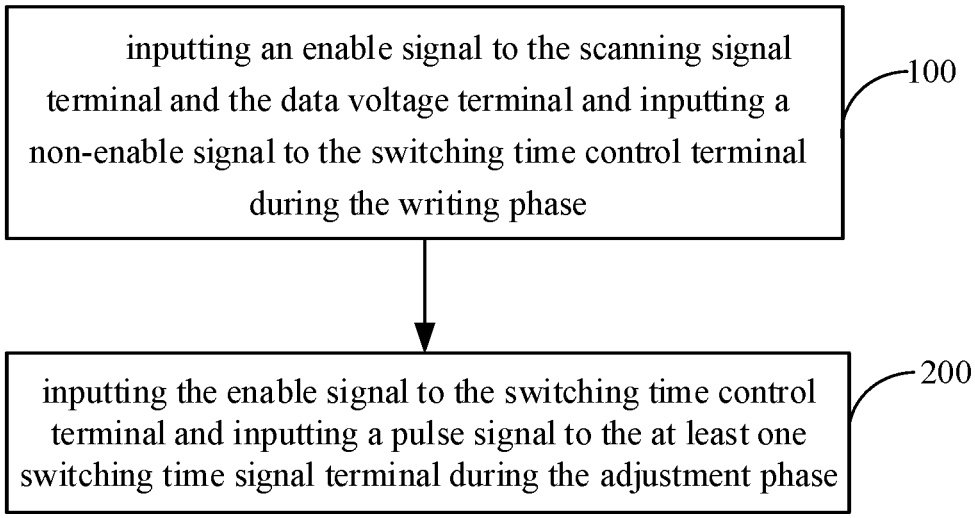
FIG. 8 shows a flow chart of a method for driving a grayscale adjustment circuit according to an embodiment of the present disclosure.

A method for driving the grayscale adjustment circuit is provided according to embodiments of the present disclosure. As shown in FIG. 8, the method includes:

step 100: inputting an enable signal to the scanning signal terminal and the data voltage terminal and inputting a non-enable signal to the switching time control terminal during the writing phase; and step 200: inputting the enable signal to the switching time control terminal and inputting a pulse signal to the at least one switching time signal terminal during the adjustment phase.

In conjunction with FIGS. 3-4, during the writing phase P1, the scanning signal terminal Gate and the data voltage terminal Data are both inputted with enable signals, the enable signal of the N-type transistor is the high level signal, the M2 is turned on, the high level signal of the data voltage terminal Data is outputted to the second transistor M2. During the writing phase P2, the switching time control terminal Gate time is inputted with the high level signal, the switching time signal terminals Data time1, Data time2 and Data time3 are inputted with the pulse signals, the M41, M42 and M43 are alternately turned on, and the LED1, LED2 and LED3 alternately emit light.

In some optional embodiments, the method further includes: inputting the pulse signals to x switching time signal terminals and inputting the non-enable signal to the remaining (n−x) switching time signal terminals. Thus, the number of the LEDs in a light-emitting state may be controlled to be x.

It should be understood that the non-enable signal of the P-type TFT is the high level signal, and the non-enable signal of the N-type TFT is the low level signal.

In some optional embodiments, the method further includes: inputting the pulse signals having a same pulse width and a same phase to the different switching time signal terminals. In this case, the plurality of LED has the same light-emitting state.

The above embodiments are merely optional embodiments of the present disclosure. It should be noted that numerous improvements and modifications may be made by those skilled in the art without departing from the principle of the present disclosure, and these improvements and modifications shall also fall within the scope of the present disclosure.

What is claimed is:

1. A grayscale adjustment circuit, comprising an input sub-circuit, a driving sub-circuit, a switching time control sub-circuit, a switching control sub-circuit and a light-emitting sub-circuit, wherein the input sub-circuit is coupled to a scanning signal terminal, a data signal terminal and the driving sub-circuit, and the input sub-circuit is configured to output a signal of the data signal terminal to the driving sub-circuit under a control of the scanning signal terminal;

the driving sub-circuit is coupled to a first voltage terminal, a second voltage terminal and the switching control sub-circuit, and the driving sub-circuit is configured to store an output signal of the input sub-circuit and output a signal of the first voltage terminal to the switching control sub-circuit under a control of the output signal of the input sub-circuit;

the switching time control sub-circuit is coupled to at least one switching time control terminal, at least one switching time signal terminal and the switching control sub-circuit, and the switching time control sub-circuit is configured to output a signal of each of the at least one switching time signal terminal to the switching control sub-circuit under a control of each of the at least one switching time control terminal;

the switching control sub-circuit is coupled to the light-emitting sub-circuit, and the switching control sub-circuit is configured to output an output signal of the driving sub-circuit to the light-emitting sub-circuit under a control of an output signal of the switching time control sub-circuit; and the light-emitting sub-circuit is coupled to the second voltage terminal, and the light-emitting sub-circuit is configured to emit light under a control of the output signal of the driving sub-circuit, wherein the input sub-circuit comprises a first transistor and the driving sub-circuit comprises a first capacitor and at least one second transistor;

a second electrode of the first transistor is coupled to the driving sub-circuit and a gate electrode of each of the at least one second transistor is coupled to the second electrode of the first transistor, and a first electrode of each second transistor is coupled to the first voltage terminal, and a second electrode of each second transistor is coupled to the switching control sub-circuit; and a first end of the first capacitor is coupled to the second electrode of the first transistor, and a second end of the first capacitor is directly connected to the second voltage terminal, wherein the first voltage terminal and the second voltage terminal are different, and a voltage of the first voltage terminal is different from a voltage of the second voltage terminal.

2. The grayscale adjustment circuit according to claim 1, wherein a gate electrode of the first transistor is coupled to the scanning signal terminal, and a first electrode of the first transistor is coupled to the data signal terminal.

3. The grayscale adjustment circuit according to claim 1, wherein the switching time control sub-circuit comprises a plurality of third transistors, gate electrodes of the plurality of third transistors are coupled to one switching time control terminal, first electrodes of the plurality of third transistors are coupled to different switching time signal terminals, and a second electrode of each of the plurality of third transistors is coupled to the switching control sub-circuit.

4. The grayscale adjustment circuit according to claim 3, wherein the number of the plurality of third transistors is same as the number of the at least one switching time signal terminal, the plurality of third transistors corresponds to the at least one switching time signal terminal respectively, and the first electrode of each of the plurality of third transistors is coupled to the corresponding switching time signal terminal.

5. The grayscale adjustment circuit according to claim 3, wherein the switching control sub-circuit comprises a plurality of fourth transistors; and a gate electrode of each of the plurality of fourth transistors is coupled to a second electrode of one of the third transistors, a first electrode of each of the plurality of fourth transistors is coupled to a second electrode of one of the at least one the second transistor, and a second electrode of each of the plurality of four transistors is coupled to the light-emitting sub-circuit.

6. The grayscale adjustment circuit according to claim 5, wherein the number of the plurality of fourth transistors is same as the number of the plurality of third transistors, the plurality of fourth transistors corresponds to the plurality of third transistors respectively, and the gate electrode of each of the plurality of fourth transistors is coupled to the second electrode of the corresponding third transistor.

7. The grayscale adjustment circuit according to claim 5, wherein the number of the at least one second transistor is same as the number of the plurality of fourth transistors, the at least one second transistor corresponds to the plurality of fourth transistors respectively, and the first electrode of each of the plurality of fourth transistors is coupled to the second electrode of the corresponding second transistor; or the number of the at least one second transistor is one, and the first electrode of each of the plurality of fourth transistors is coupled to the second electrode of the second transistor.

8. The grayscale adjustment circuit according to claim 5, wherein the light-emitting sub-circuit comprises a plurality of light-emitting diodes, and the plurality of light-emitting diodes corresponds to the plurality of fourth transistors respectively; and a first electrode of each of the plurality of light-emitting diodes is coupled to a second electrode of the corresponding fourth transistor, and a second electrode of each of the plurality of light-emitting diodes is coupled to the second voltage terminal.

9. The grayscale adjustment circuit according to claim 8, wherein in the case that the voltage of the first voltage terminal is higher than the voltage of the second voltage terminal, the first electrodes of the plurality of light-emitting diodes are anodes, and the second electrodes of the plurality of light-emitting diodes are cathodes; or in the case that the voltage of the first voltage terminal is lower than the voltage of the second voltage terminal, the first electrodes of the plurality of light-emitting diodes are cathodes, and the second electrodes of the plurality of light-emitting diodes are anodes.

10. The grayscale adjustment circuit according to claim 5, wherein all the transistors in the grayscale adjustment circuit are N-type transistors or P-type transistors.

11. A display device, comprising the grayscale adjustment circuit according to claim 1.

12. A method for driving the grayscale adjustment circuit according to claim 1, wherein each work cycle of the grayscale adjustment circuit comprises a writing phase and an adjustment phase, and the method comprises:

inputting an enable signal to the scanning signal terminal and the data voltage terminal and inputting a non-enable signal to the at least one switching time control terminal during the writing phase; and inputting the enable signal to the at least one switching time control terminal and inputting a pulse signal to the at least one switching time signal terminal during the adjustment phase.

13. The method according to claim 12, wherein the number of the at least one switching time signal terminal is n, the light-emitting sub-circuit comprises n light emitting diodes (LEDs), and the method further comprises:

inputting, during the adjustment phase, the pulse signal to x switching time signal terminals and inputting the non-enable signal to remaining (n–x) switching time signal terminals to control the number of the LEDs in a light-emitting state to be x, wherein the x and the n both are positive integers and x is less than or equal to n.

14. A grayscale adjustment circuit, comprising an input sub-circuit, a driving sub-circuit, a switching time control sub-circuit, a switching control sub-circuit and a light-emitting sub-circuit, wherein the input sub-circuit is coupled to a scanning signal terminal, a data signal terminal and the driving sub-circuit, and the input sub-circuit is configured to output a signal of the data signal terminal to the driving sub-circuit under a control of the scanning signal terminal;

the driving sub-circuit is coupled to a first voltage terminal, a second voltage terminal and the switching control sub-circuit, and the driving sub-circuit is configured to store an output signal of the input sub-circuit and output a signal of the first voltage terminal to the switching control sub-circuit under a control of the output signal of the input sub-circuit;

the switching time control sub-circuit is coupled to at least one switching time control terminal, at least one switching time signal terminal and the switching control sub-circuit, and the switching time control sub-circuit is configured to output a signal of each of the at least one switching time signal terminal to the switching control sub-circuit under a control of each of the at least one switching time control terminal;

the switching control sub-circuit is coupled to the light-emitting sub-circuit, and the switching control sub-circuit is configured to output an output signal of the driving sub-circuit to the light-emitting sub-circuit under a control of an output signal of the switching time control sub-circuit; and the light-emitting sub-circuit is coupled to the second voltage terminal, and the light-emitting sub-circuit is configured to emit light under a control of the output signal of the driving sub-circuit, wherein the input sub-circuit comprises a first transistor and the driving sub-circuit comprises a first capacitor and at least one second transistor;

a second electrode of the first transistor is coupled to the driving sub-circuit and a gate electrode of each of the at least one second transistor is coupled to the second electrode of the first transistor, and a first electrode of each second transistor is coupled to the first voltage terminal, and a second electrode of each second transistor is coupled to the switching control sub-circuit; and a first end of the first capacitor is coupled to the second electrode of the first transistor, and a second end of the first capacitor is directly connected to the second voltage terminal, wherein the switching time control sub-circuit comprises a plurality of third transistors, wherein the switching control sub-circuit comprises a plurality of fourth transistors; a gate electrode of each of the plurality of fourth transistors is coupled to a second electrode of one of the third transistors, a first electrode of each of the plurality of fourth transistors is coupled to a second electrode of one of the at least one the second transistor, and a second electrode of each of the plurality of four transistors is coupled to the light-emitting sub-circuit;

wherein the number of the at least one second transistor is the same as the number of the plurality of fourth transistors, the at least one second transistor corresponds to the plurality of fourth transistors respectively, and the first electrode of each of the plurality of fourth transistors is coupled to the second electrode of the corresponding second transistor.

* * * * *